United States Patent [19]

Kosal

[11] Patent Number: 5,035,827

[45] Date of Patent: Jul. 30, 1991

[54] LIQUID DETERGENT CONTAINING STABILIZED SILICATES

[75] Inventor: Jeffrey A. Kosal, Midland County, Mich.

[73] Assignee: Dow Corning Corporation, Midland, Mich.

[21] Appl. No.: 446,500

[22] Filed: Dec. 5, 1989

[51] Int. Cl.[5] ..... C11D 3/04; C11D 7/06; C11D 17/00; C11D 11/00

[52] U.S. Cl. ..... 252/135; 252/156; 252/173; 252/174.15; 252/DIG. 14

[58] Field of Search ..... 252/135, 173, 174.15, 252/DIG. 14

[56] References Cited

U.S. PATENT DOCUMENTS

| | | | |
|---|---|---|---|
| 4,344,860 | 8/1982 | Plueddemann | 556/401 |
| 4,416,793 | 11/1983 | Barrat et al. | 252/117 |
| 4,534,880 | 8/1985 | Kosal et al. | 252/174.13 |
| 4,549,979 | 10/1985 | Chandra et al. | 252/135 |
| 4,741,862 | 5/1988 | Kosal | 252/527 |
| 4,780,234 | 10/1988 | Malik et al. | 252/135 |
| 4,784,799 | 11/1988 | Petroff | 252/545 |

*Primary Examiner*—Paul Lieberman
*Assistant Examiner*—Kevin D. McCarthy
*Attorney, Agent, or Firm*—Jim L. DeCesare

[57] ABSTRACT

A builder free liquid detergent including at least one surfactant selected from the group consisting of non-ionic, anionic, cationic, ampholytic, and zwitterionic surfactants, and a mixture of (i) a synthetic inorganic soluble alkali silicate of the formula $$(MO)_aSiO_{4-a/2}$$

wherein a is an integer between one and three, and M is a cation selected from the group consisting of alkali metal cations and tetraorganoammonium cations, and (ii) an anionic siliconate of the formula $$(MO)_aO_{(3-a)/2}Si\text{-}R\text{-}Y_b$$

wherein Y represents an alkali metal salt of an oxyacid; R is an organic linking group or other functionality selected from the group consisting of ether, sulfide, hydroxy, amide, and amine, positioned at least two carbon atoms removed from the silicon atom; a has a value of from one to three, b is an integer from one to three, and M is an alkali metal cation or hydrogen.

22 Claims, No Drawings

LIQUID DETERGENT CONTAINING STABILIZED SILICATES

BACKGROUND OF THE INVENTION

This invention is directed to a liquid detergent which contains a stabilized silicate. More particularly, the invention relates to builder free liquid detergent formulations which include a mixture of a synthetic inorganic soluble alkali silicate and an anionic siliconate.

Solid detergent formulations are sold in powder or granular form. A disadvantage of solid detergents is that, on account of the hygroscopicity of individual raw materials of the formulation, the solid detergent shows a pronounced tendency towards caking or clumping in the presence of small quantities of moisture. This does not make the detergent unusable, however, because the effect of the individual components of the detergent remain intact even after clumping or caking in the presence of moisture. However, the appearance of the detergent in most cases is diminished. As a result, there has been a desire to develop liquid detergent compositions for use in lieu of conventionally formulated solid detergent compositions. The liquid detergent allows for use of lower washing temperatures inclusive of cold water laundering. Granular detergents have not fully adapted to such variations because of weaknesses in respect of dissolving speed, insolubility, and cleaning efficiency. Due to such problems of caking and the slowness of solid and granular detergents to dissolve, trends in detergent manufacture have leaned toward the liquid detergent. Such detergents usually include an organic surfactant, water, various detergent builder systems, enzymes, bleaches, pH modifiers, softeners, and solvents. It is not uncommon to also include an antifoam or defoamer formulation as part of the detergent package.

Soluble silicates have always been an important raw material in the manufacture of detergents. Various tests of silicates in detergents conclude that soluble silicates improve detergency. However, developments of new forms of liquid detergents with neutral pH's and concentrated detergents have affected the use of silicates. Modern detergents, including liquid detergents, are complex mixtures of ingredients optimized for beneficial cleaning activity at low cost while minimizing the objectionable features of individual components. Commercial liquid detergent systems are primarily nonionic and/or anionic neutral surfactant systems. When soluble silicates are used however, undesirable effects such as gel formation, liquid phase separation, precipitation formation, and incompatability occur, and thus prevent silicate use in liquid detergents. The present invention however provides for the addition of anionic siliconates to alkali silicate solutions, to provide stable solutions that resist precipitation/gelation when neutralized or acidified. These stabilized silicate solutions, after adjusting the pH to optimized levels, can be added to any liquid detergent formulation and will remain completely compatible and stable.

SUMMARY OF THE INVENTION

This invention relates to a builder free liquid detergent which includes at least one surfactant selected from the group consisting of nonionic, anionic, cationic, ampholytic, and zwitterionic surfactants, and a mixture of (i) a synthetic inorganic soluble alkali silicate of the formula $$(MO)_aSiO_{4-a/2}$$

wherein a is an integer between one and three, and M is a cation selected from the group consisting of alkali metal cations and tetraorganoammonium cations, and (ii) an anionic siliconate of the formula $$(MO)_aO_{(3-a)/2}Si\text{-}R\text{-}Y_b$$

wherein Y represents an alkali metal salt of an oxyacid; R is an organic linking group or other functionality selected from the group consisting of ether, sulfide, hydroxy, amide, and amine, positioned at least two carbon atoms removed from the silicon atom; a has a value of from one to three, b is an integer from one to three, and M is an alkali metal cation or hydrogen.

The mixture is preferably in the form of a solution, although powdered forms may be delivered, and the solution generally constitutes from about one percent to about fifty percent by weight based on the weight of the detergent. The solution, however, more particularly constitutes from about ten to about twenty-five percent by weight based on the weight of the detergent. The alkali silicate and the anionic siliconate are generally present in the mixture in a weight ratio of from about ten to one to about one to one. Most preferably, however, the alkali silicate and the anionic siliconate are present in the mixture in an amount of about five parts by weight of the alkali silicate per part of anionic siliconate. While the pH of the liquid detergent including the mixture may be from about six to about ten, the pH is preferably from about 6.5 to about 8.5.

The anionic siliconates can be in several forms and representative anionic siliconate compounds most preferred for purposes of the present invention are depicted in the following formulas $$(NaO)_{0.2}(HO)_{2.8}SiCH_2CH_2CH_2O\underset{\underset{CH_3}{|}}{\overset{\overset{O}{\|}}{P}}-O^-Na^+ \qquad \text{I}$$

$$(NaO)_{0.2}(HO)_{2.8}SiCH_2CH_2CH_2N\underset{\underset{CH_2CH_2COO^-Na^+}{|}}{CH_2CH_2}N(CH_2CH_2COO^-Na^+)_2 \qquad \text{II}$$

$$(NaO)_{0.2}(HO)_{2.8}SiCH_2CH_2CH_2\underset{\underset{R}{|}}{N}CH_2CH_2R_2 \qquad \text{III}$$

wherein R is $CH_2CH_2SO_3^-Na^+$.

$$(NaO)_{0.2}(HO)_{2.8}SiCH_2CH_2SCH_2COO^-Na^+, \text{ and} \qquad \text{IV}$$

$$(NaO)_{0.2}(HO)_{2.8}SiCH_2CH_2COO^-Na^+. \qquad \text{V}$$

For the sake of convenience, these compounds are referred to in Tables I and II with reference to the Roman numerals set forth above which appear at the end of each formula.

These and other features, objects, and advantages, of the herein described present invention will become more apparent when considered in light of the following detailed description thereof.

DETAILED DESCRIPTION OF THE INVENTION

As noted hereinabove, the builder free liquid detergent includes at least one surfactant selected from the group consisting of nonionic, anionic, cationic, ampholytic, and zwitterionic surfactants. Representative of such surfactants are any of the numerous categories and types of surfactants specifically enumerated in such patents as U.S. Pat. No. 4,798,679, issued Jan. 17, 1989, and U.S. Pat. No. 4,844,821, issued July 4, 1989. These patents are considered incorporated herein by reference and generally relate to liquid detergent systems containing various surfactant systems known in the art.

The builder free liquid detergent composition of the present invention also includes a mixture of a synthetic inorganic soluble alkali silicate and an anionic siliconate. The alkali silicate has the formula $$(MO)_aSiO_{4-a/2}$$

wherein a is an integer between one and three, and M is a cation selected from the group consisting of alkali metal cations and tetraorganoammonium cations. It should be noted that in the above formula, M can be selected from two different cationic groups which are the alkali metal cations and the tetraorganoammonium cations. Thus, M for purposes of the present invention can be selected from sodium, potassium, lithium, and rubidium, while the tetraorganoammonium cations can be selected from tetra(alkyl)ammonium cations; tetra-(mixed aryl-alkyl and mixed aralkyl-alkyl)ammonium cations; and the tetra(hydroxyalkyl)ammonium cations. Preferred are tetra(methyl)ammonium, tetra(ethyl)ammonium, phenyltrimethylammonium, benzyltrimethylammonium, and tetra(hydroxyethyl)ammonium cations. Also considered within the scope of the invention are the polyvalent cations produced by converting polyamines such as quanidine or ethylenediamine to polyammonium hydroxides. Such silicates are all well known in the prior art.

Anionic siliconates are known materials and are described in U.S. Pat. Nos. 3,198,820, 3,816,184, 4,235,638, 4,344,860, 4,352,742, 4,354,002, 4,362,644, 4,370,255 and 4,534,880, which are hereby incorporated by reference to illustrate the anionic functional siliconates and to show methods for their preparation. The general form of the anionic siliconates can be represented by the formula:

$$(MO)_aO_{(3-A)/2}Si\text{-}R\text{-}Y_b$$

wherein R is an organic linking group wherein the anionic functionality or any other functionality is positioned at least 2 and preferably at least 3 carbon atoms removed from the silicon atom and Y represents anionic functional groups and b represents the number of anionic functional groups on the linking group and can vary from 1 to 3. In the formula, M represents the cation of a strong base such as alkali metal cations or organo quaternary ammonium cations or M represents a hydrogen such that the siliconate also contains silanol functionality. Generally a can vary from about 1 to 3.

It is preferred that a has the value of 3 to about 2 such that the anionic siliconate is predominately a monomeric species in aqueous solutions. Monomers are preferred. It should be understood however that oligomeric anionic siliconates where a is 1 to about 2 are also useful in the invention. Under alkaline conditions the oligomers are in equilibrium with monomers. It should also be apparent that if desired the equilibrium can be shifted toward monomeric species by the addition of alkali metal hydroxide to the aqueous solution of the siliconate.

The organic linking group, R, may contain other atoms in addition to carbon and hydrogen such as, for example, oxygen, sulfur, and nitrogen. These atoms may be present, as other functional groups such as, for example, ether, sulfide, hydroxy, amide, or amine. Other functionality as represented by these exemplary atoms should be positioned at least 2 and preferably 3 or more carbon atoms removed from the site of silicon atom attachment in the linking group. Such positioning of functionality within the linking group provides substitutents on silicon that are more stable and less readily cleaved. Generally it is preferred that the linking group contain from 2 to a maximum of about 16 carbon atoms. While linking groups with greater than 16 carbon atoms may be used in the invention, it is believed that the hydrophobic character produced by such linking groups reduce the effectiveness of the siliconates so that the linking groups with greater than 16 carbon atoms are less preferred.

Linking groups represented by R include, among others, polyvalent hydrocarbon radicals such as dimethylene, trimethylene, hexadecamethylene, phenylene, tolylene, xenylene, naphthylene, and substituted polyvalent hydrocarbon radicals such as $-(CH_2)_3OCH_2CH(OH)CH_2-$,

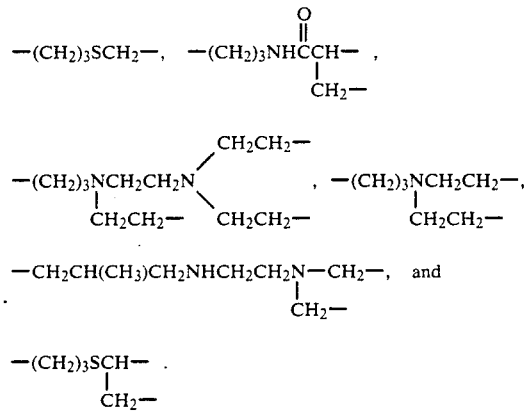

Generally when M is an alkali metal cation it is preferred that it be sodium because of its ready availability and low cost. Similarly, the sodium salts of the oxyacids are preferred anionic functional groups in the siliconates.

For example anionic siliconates suitable for the present invention include compositions conforming generally to the formulas:

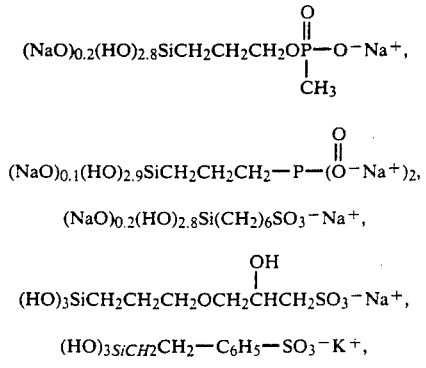

-continued $$(KO)_{0.2}(HO)_{2.8}SiCH_2CH_2SCH_2COO^-K^+,$$

$$(NaO)_{0.1}(HO)_{2.9}SiCH_2CH_2CH_2SCH(CH_2COO^-Na^+)COO^-Na^+,$$

$$(HO)_3SiCH_2CH(CH_3)CH_2N(CH_2CH_2COO^-Na^+)_2,$$

$$(HO)_3SiCH_2CH_2CH_2NHCH_2CH_2N(CH_2COO^-Na^+)_2,$$

$$(NaO)_{0.2}(HO)_{2.8}SiCH_2CH_2N(CH_2CH_2COO^-Na^+)CH_2CH_2N(CH_2CH_2COO^-Na^+)_2$$

$$(NaO)_{0.1}(HO)_{2.9}SiCH_2CH_2CH_2NHC(=O)CH(CH_2COO^-Na^+)SO_3^-Na^+,$$

$$(NaO)_{0.2}(HO)_{2.8}SiCH_2CH_2CH_2N(CH_2SO_3^-Na^+)CH_2CH_2N(CH_2SO_3^-Na^+)_2, \text{ and}$$

$$(NaO)_{0.2}(HO)_{2.8}SiCH_2CH_2COO^-Na^+.$$

The following examples are set forth in order to further illustrate the concept of the present invention. The results obtained in the examples are tabulated in Tables I and II. Table I shows the storage stability of various liquid laundry detergents containing ten percent by weight of the stabilized siliconate-sodium silicate mixture based on the weight of the detergent. The weight ratio of silicate to siliconate in Table I was five to one. Storage stability of the various liquid laundry detergent formulations is reflected as the time in hours for solution incompatibility to occur at room temperature. Table I also identifies the particular pH of the unstabilized control that was employed, as well as the pH of each of the various liquid laundry detergents that were formulated. Table II is identical to Table I except that liquid dishwashing detergents were employed rather than liquid laundry detergents. In both Tables I and II, the compounds identified by Roman numerals I to V correspond to the following anionic siliconates:

$$(NaO)_{0.2}(HO)_{2.8}SiCH_2CH_2CH_2OP(=O)(CH_3)-O^-Na^+ \quad \text{I}$$

$$(NaO)_{0.2}(HO)_{2.8}SiCH_2CH_2CH_2N(CH_2CH_2COO^-Na^+)CH_2CH_2N(CH_2CH_2COO^-Na^+)_2 \quad \text{II}$$

$$(NaO)_{0.2}(HO)_{2.8}SiCH_2CH_2CH_2N(R)CH_2CH_2R_2 \quad \text{III}$$

wherein R is $CH_2CH_2SO_3^-Na^+$.

$$(NaO)_{0.2}(HO)_{2.8}SiCH_2CH_2SCH_2COO^-Na^+, \text{ and} \quad \text{IV}$$

$$(NaO)_{0.2}(HO)_{2.8}SiCH_2CH_2COO^-Na^+. \quad \text{V}$$

It will be noted from a consideration of Tables I and II, that all of the liquid detergent formulations tested possessed a neutral, or approximating neutral pH, or were slightly alkaline. By slightly alkaline is meant a pH of less than about ten. For instance, the pH range of the liquid laundry detergents of Table I was 6.7 to 8.3, whereas in Table II the range for the liquid dishwashing detergents was 6.5 to 7.8. Thus, the stabilized silicates of the present invention are especially effective in liquid detergent systems where the pH does not exceed about ten. In instances where a pH of ten is exceeded, unstabilized silicates are somewhat effective only because of the high pH, but where the pH is below about ten, the unstabilized silicates are caused to form gels and precipitates in the liquid detergent as previously noted, and require and anionic siliconate in order to provide stable and compatible liquid detergent compositions. However, even in those instances where the pH does exceed about ten, the anionic siliconates are still required in order to prevent the formation of gels due to the neutralizing effects of carbon dioxide caused by exposure in open air.

EXAMPLE I

Several commercial heavy duty liquid laundry detergents were obtained for testing. Liquid detergent pH measurements showed the systems to be primarily neutral. Five parts of 1 molal (10% solids) sodium silicate with a $SiO_2/Na_2O$ ratio of 3.22/1 was equilibrated with one part of 1 molal siliconate for a minimum of 1 hour at 75° C. Monomeric siliconate species with two to three ($Na^+O^-$) groups on silicon do not require equilibriation. The stabilized silicate solution was adjusted to various pH levels using 10% HCl and/or 10% NaOH. The solutions were prepared at pH levels of 7, 8, 9 and 11.5. 11.5 was the pH of the solution before pH adjustment. A 10% loading of the various pH stabilized silicate solutions was added to samples of the liquid laundry detergents in 1 ounce vials, capped, and lightly shaken for 10–15 seconds to mix. Room temperature stability was observed for the samples with results recorded after 1 hour, 4 hours, 24 hours, 72 hours, 1 week and thereafter weekly. As shown in Table I, the control samples with unstabilized silicate, had negative interaction relatively soon. Stabilized silicate solutions at a pH of 11.5 were beneficial in two of the five samples. However, where the stabilized silicate solutions were pH adjusted toward a more neutral value to match the pH value of the detergent, they were more compatible with the detergent system and remained compatible and stable.

TABLE I

STORAGE STABILITY OF LIQUID LAUNDRY DETERGENTS CONTAINING TEN PERCENT STABILIZED SILICONATE-SODIUM SILICATE AT 5 TO 1 WEIGHT RATIO SILICATE-SILICONATE
TIME IN HOURS TO SOLUTION INCOMPATABILITY AT ROOM TEMPERATURE

| SILICONATE | pH | CLING FREE ® pH 7.1 | DYNAMO ® II pH 7.8 | YES ® pH 8.3 | ERA PLUS ® pH 7.5 | SOLO ® pH 6.7 |
|---|---|---|---|---|---|---|
| UNSTABILIZED CONTROL | 11.5 | .08 | 1.0 | .16 | .3 | .08 |
| I | 11.5 | 48 | 168+ | 504 | 24 | 4 |
| | 9.2 | 72 | 72 | 168+ | 24 | 168+ |

TABLE I-continued

STORAGE STABILITY OF LIQUID LAUNDRY DETERGENTS CONTAINING TEN PERCENT STABILIZED SILICONATE-SODIUM SILICATE AT 5 TO 1 WEIGHT RATIO SILICATE-SILICONATE TIME IN HOURS TO SOLUTION INCOMPATABILITY AT ROOM TEMPERATURE

| SILICONATE | pH | CLING FREE ® pH 7.1 | DYNAMO ® II pH 7.8 | YES ® pH 8.3 | ERA PLUS ® pH 7.5 | SOLO ® pH 6.7 |
|---|---|---|---|---|---|---|
| | 8.5 | 72 | 24 | 72 | 168+ | 168+ |
| | 7.0 | 168+ | — | — | — | — |
| II | 11.5 | 3 | 168+ | 48 | 48 | 4.0 |
| | 9.0 | 168+ | 168+ | 168+ | 168+ | 168+ |
| | 8.0 | 168+ | 168+ | 168+ | 168+ | 168+ |
| | 7.2 | 168+ | 168+ | 168+ | 168+ | 168+ |
| III | 11.5 | 24 | — | — | — | — |
| | 9.0 | 1.0 | 168+ | 168+ | 168 | 1.0 |
| | 8.0 | 1.0 | 168+ | 168+ | 168 | 1.0 |
| | 7.0 | 168+ | 168+ | 168+ | 168 | 1.0 |
| IV | 11.5 | 48 | 168+ | 240 | 48 | .16 |
| | 8.5 | 1.0 | 168 | 168+ | 24 | 1.0 |
| | 7.8 | 1.0 | 168 | 168+ | 24 | 1.0 |
| V | 11.5 | .16 | 168+ | 1.0 | 4.0 | .16 |

EXAMPLE II

Example I was repeated except that light duty liquid hand dishwashing detergent formulations were employed. The formulations were neutral systems. The procedure used in the previous example was followed, and the results are set forth in Table II.

TABLE II

STORAGE STABILITY OF LIQUID DISHWASHING DETERGENT CONTAINING TEN PERCENT STABILIZED SILICONATE SODIUM SILICATE AT 5 TO 1 RATIO SILICATE-SILICONATE TIME IN HOURS TO SOLUTION INCOMPATABILITY AT ROOM TEMPERATURE

| SILICONATE | pH | JOY ® pH 6.5 | SUNLIGHT ® pH 6.6 | DAWN ® pH 6.6 | PALMOLIVE ® pH 7.8 |
|---|---|---|---|---|---|
| UNSTABILIZED CONTROL | 11.5 | 0.8 | 0.8 | 0.8 | 1.0 |
| I | 11.5 | 24 | 24 | 24 | 96 |
| | 9.1 | 168+ | 96 | 96 | 168+ |
| | 8.5 | 168+ | 96 | 96 | 96 |
| II | 11.5 | 24 | 168+ | 24 | 168+ |
| | 9.0 | 168+ | 168+ | 168+ | 168+ |
| | 8.0 | 168+ | 168+ | 168+ | 168+ |
| | 7.0 | 96 | 168+ | 96 | 168+ |
| III | 11.5 | 168+ | 168+ | 96 | 168+ |
| | 9.1 | 168+ | 168+ | 168+ | 168+ |
| | 8.2 | 168+ | 168+ | 168+ | 168+ |
| | 7.0 | 168+ | 168+ | 168+ | 168+ |
| IV | 11.5 | — | — | — | — |
| | 8.1 | 168+ | 168+ | 96 | 168+ |
| | 7.0 | 24 | 96 | 96 | 168+ |
| V | 11.5 | 0.8 | 24 | 0.8 | 24 |

It will be apparent from the foregoing that many other variations and modifications may be made in the compounds, compositions, structures, and methods, described herein, without departing substantially from the essential features and concepts of the present invention. Accordingly, it should be clearly understood that the forms of the invention described herein are exemplary only and are not intended as limitations on the scope of the present invention as defined in the appended claims.

That which is claimed is:

1. In a liquid detergent having a pH of 6.5 to 8.5 including at least one surfactant selected from the group consisting of nonionic, anionic, cationic, ampholytic, and zwitterionic surfactants, the improvement comprising an additive for the liquid detergent which is a mixture of (i) a synthetic inorganic soluble alkali silicate of the formula $$(MO)_aSiO_{4-a/2}$$

wherein a is an integer between one and three, and M is a cation selected from the group consisting of alkali metal cations and tetraorganoammonium cations, and (ii) an anionic siliconate of the formula $$(MO)_aO_{(3-a)/2}Si\text{-}R\text{-}Y_b$$

wherein Y represents an alkali metal salt of an oxyacid; R is an organic linking group; Y is positioned at least two carbon atoms removed from the silicon atom; a has a value of from one to three, b is an integer from one to three, and M is an alkali metal cation or hydrogen.

2. The detergent of claim 1 wherein the additive mixture is in the form of a solution and the additive solution constitutes from about one percent to about fifty percent by weight based on the weight of the detergent.

3. The detergent of claim 2 wherein the solution constitutes from about ten to about twenty-five percent by weight based on the weight of the detergent.

4. The detergent of claim 1 wherein the alkali silicate and the anionic siliconate are present in the additive mixture in a weight ratio of from about ten to one to about one to one respectively.

5. The detergent of claim 4 wherein the alkali silicate and the anionic siliconate are present in the additive mixture in an amount of about five parts by weight of the alkali silicate per part of anionic siliconate.

6. The detergent of claim 1 in which the anionic siliconate is a compound of the formula $$(NaO)_{0.2}(HO)_{2.8}SiCH_2CH_2CH_2O\overset{\overset{O}{\|}}{\underset{\underset{CH_3}{|}}{P}}-O^-Na^+$$

7. The detergent of claim 1 in which the anionic siliconate is a compound of the formula $$(NaO)_{0.2}(HO)_{2.8}SiCH_2CH_2CH_2\underset{\underset{CH_2CH_2COO^-Na^+}{|}}{N}CH_2CH_2N(CH_2CH_2COO^-Na^+)_2$$

8. The detergent of claim 1 in which the anionic siliconate is a compound of the formula $$(NaO)_{0.2}(HO)_{2.8}SiCH_2CH_2CH_2\underset{\underset{R}{|}}{N}CH_2CH_2R_2$$

wherein R is $CH_2CH_2SO_3^-Na^+$.

9. The detergent of claim 1 in which the anionic siliconate is a compound of the formula $(NaO)_{0.2}(HO)_{2.8}SiCH_2CH_2SCH_2COO^-Na^+$ 10. The detergent of claim 1 in which the anionic siliconate is a compound of the formula $(NaO)_{0.2}(HO)_{2.8}SiCH_2CH_2COO^-Na^+$ 11. A liquid detergent having a pH of 6.5 to 8.5 comprising at least one surfactant selected from the group consisting of nonionic, anionic, cationic, ampholytic, and zwitterionic surfactants, and a mixture of (i) a synthetic inorganic soluble alkali silicate of the formula $$(MO)_aSiO_{4-a/2}$$

wherein a is an integer between one and three, and M is a cation selected from the group consisting of alkali metal cations and tetraorganoammonium cations, and (ii) an anionic siliconate of the formula $$(MO)_aO_{(3-a)/2}Si\text{-}R\text{-}Y_b$$

wherein Y represents an alkali metal salt of an oxyacid; R is an organic linking group; Y is positioned at least two carbon atoms removed from the silicon atom; a has a value of from one to three, b is an integer from one to three, and M is an alkali metal cation or hydrogen.

12. The detergent of claim 11 wherein the mixture is in the form of a solution and the solution constitutes from about one percent to about fifty percent by weight based on the weight of the detergent.

13. The detergent of claim 12 wherein the solution constitutes from about ten to about twenty-five percent by weight based on the weight of the detergent.

14. The detergent of claim 11 wherein the alkali silicate and the anionic siliconate are present in the mixture in a weight ratio of from about ten to one to about one to one respectively.

15. The detergent of claim 14 wherein the alkali silicate and the anionic siliconate are present in the mixture in an amount of about five parts by weight of the alkali silicate per part of anionic siliconate.

16. The detergent of claim 11 in which the anionic siliconate is a compound of the formula $$(NaO)_{0.2}(HO)_{2.8}SiCH_2CH_2CH_2O\overset{\overset{O}{\|}}{\underset{\underset{CH_3}{|}}{P}}-O^-Na^+$$

17. The detergent of claim 11 in which the anionic siliconate is a compound of the formula $$(NaO)_{0.2}(HO)_{2.8}SiCH_2CH_2CH_2\underset{\underset{CH_2CH_2COO^-Na^+}{|}}{N}CH_2CH_2N(CH_2CH_2COO^-Na^+)_2$$

18. The detergent of claim 11 in which the anionic siliconate is a compound of the formula $$(NaO)_{0.2}(HO)_{2.8}SiCH_2CH_2CH_2\underset{\underset{R}{|}}{N}CH_2CH_2R_2$$

wherein R is $CH_2CH_2SO_3^-Na^+$.

19. The detergent of claim 11 in which the anionic siliconate is a compound of the formula $$(NaO)_{0.2}(HO)_{2.8}SiCH_2CH_2SCH_2COO^-Na^+$$

20. The detergent of claim 11 in which the anionic siliconate is a compound of the formula $$(NaO)_{0.2}(HO)_{2.8}SiCH_2CH_2COO^-Na^+$$

21. In a liquid detergent including at least one surfactant selected from the group consisting of nonionic, anionic, cationic, ampholytic, and zwitterionic surfactants, the improvement comprising an additive for the liquid detergent which is a mixture of (i) a synthetic inorganic soluble alkali silicate of the formula $$(MO)_aSiO_{4-a/2}$$

wherein a is an integer between one and three, and M is a cation selected from the group consisting of alkali metal cations and tetraorganoammonium cations, and (ii) an anionic siliconate of the formula $$(MO)_aO_{(3-a)/2}Si\text{-}R\text{-}Y_b$$

wherein Y represents an alkali metal salt of an oxyacid; R is an organic linking group; Y is positioned at least two carbon atoms removed from the silicon atom; a has a value of from one to three, b is an integer from one to three, and M is an alkali metal cation or hydrogen, the additive being present in an amount of from about one percent to about fifty percent by weight based on the weight of the detergent, the silicate and the anionic siliconate being present in the additive in a weight ratio of from about ten to one to about one to one, and the pH of the liquid detergent including the additive being from about 6.5 to 8.5.

22. A liquid detergent comprising at least one surfactant selected from the group consisting of nonionic, anionic, cationic, ampholytic, and zwitterionic surfactants, and a mixture of (i) a synthetic inorganic soluble alkali silicate of the formula $$(MO)_aSiO_{4-a/2}$$

wherein a is an integer between one and three, and M is a cation selected from the group consisting of alkali metal cations and tetraorganoammonium cations, and (ii) an anionic siliconate of the formula $$(MO)_aO_{(3-a)/2}Si\text{-}R\text{-}Y_b$$

wherein Y represents an alkali metal salt of an oxyacid; R is an organic linking group; Y is positioned at least two carbon atoms removed from the silicon atom; a has a value of from one to three, b is an integer from one to three, and M is an alkali metal cation or hydrogen, the mixture being present in an amount of from about one percent to about fifty percent by weight based on the weight of the detergent, the silicate and the anionic siliconate being present in the mixture in a weight ratio of from about ten to one to about one to one, and the pH of the liquid detergent including the mixture being from about 6.5 to 8.5.

* * * * *